US005464212A

United States Patent [19]

Cook

[11] Patent Number: 5,464,212

[45] Date of Patent: Nov. 7, 1995

[54] GOLF CLUB PUTTER

[76] Inventor: Thomas A. Cook, 9343 Blazing Star Tr., Garden Ridge, Tex. 78266-2311

[21] Appl. No.: 364,552

[22] Filed: Dec. 27, 1994

[51] Int. Cl.[6] ..... A63B 53/04

[52] U.S. Cl. ..... 273/78; 273/167 H; 273/173; 273/167 E; 273/DIG. 9

[58] Field of Search ..... 273/77 R, 78, 273/170, 171, 172, 173, 193 R, 186.2, 167 J, 167 H, 167 R, 167 F, 169, DIG. 4, DIG. 9, DIG. 10, DIG. 11, 174

[56] References Cited

U.S. PATENT DOCUMENTS

| | | | |
|---|---|---|---|
| 3,211,455 | 10/1965 | Hyden | 273/173 |
| 3,387,844 | 6/1968 | Shippee | 273/173 |
| 3,989,248 | 11/1976 | Campau | 273/78 |
| 4,113,249 | 9/1978 | Beery | 273/78 |
| 4,884,812 | 12/1989 | Nagasaki | 273/78 |
| 5,054,784 | 10/1991 | Collins | 273/167 E |
| 5,332,214 | 7/1994 | Tucker | 273/171 |
| 5,342,052 | 8/1994 | Costa | 273/171 |
| 5,366,222 | 11/1994 | Lee | 273/169 |

*Primary Examiner*—Sebastiano Passaniti

[57] ABSTRACT

A golf putter having a novel putter head is disclosed. The putter head assembly includes a putter body of rigid material, preferrably metal, and a resilient full face single layer elastomeric striking face insert. The putter body and insert are joined together through the use of a shear joint around the periphery of the parts and bonded together using a structural adhesive designed for shock absorbing devices. Air/gas egress holes are incorporated within the putter body to eliminate compressibility effects of the air contained within the internal cavity, created upon assembly of the putter body and the elastomeric striking face insert.

6 Claims, 3 Drawing Sheets

GOLF CLUB PUTTER

BACKGROUND OF THE INVENTION

Research shows one of the earliest known putters having a striking face made from a resilient material disclosed in U.S. Pat. No. 3,211,455 to Hyden. He uses a resilient rubber having a hardness between about 65 and 85 durometers. He utilizes a laminated striking face that is stated to give the golfer a greater sense of feel during the stroke of the ball. Hyden's concept discloses theory of a resilient surface laminated to the face of the putter, to reduce the rebound of the ball. Does not address the idea of increasing work required and/or performed by a golf club putter, nor dispersing the energy of impact.

U.S. Pat. No. 3,218,072 to Burr discloses golf club heads using prestressed porous carbon inserts to form the striking surface, to increase rebound. An opposite view of this application.

U.S. Pat. No. 3,975,023 to Inamori discloses using ceramics for face plates, designed to be extremely non-yielding and increase flying distance of the ball. Does not address or achieve increased work required and/or performed.

U.S. Pat. No. 4,156,526 to Huggins, et.al. discloses a putter head defining an elongated cavity which is filled with a resilient block serving as the striking face of the putter. Does not achieve increase work required and/or performed, due to filling of cavity with resilient material.

U.S. Pat. No. 4,199,144 to Skelly discloses a putter having a striking face made of rock hard plastic, allowing delivery of a stronger force to the golf ball, thereby allowing the ball to travel 4–8 inches farther than conventionally expected. An opposite view of this invention.

U.S. Pat. No. 4,204,684 to Molitor shows laminated layers used as a striking face secured to a golf club body, thereby rendering use of sole plates or inserts unnecessary. An opposing view of this invention.

U.S. Pat. No. 4,422,638 to Tucker discloses a golf putter having a soft face form from an elastomer having high resiliency and a hardness greater than about 70 durometer A. The high resiliency of the elastomer is believed to cause the ball to rebound sharply without energy loss, thereby increasing the distance of travel of the ball. Tucker laminates a soft face to a surface for sharp rebound. Does not address or try to achieve increased work required and/or performed, nor dispersal of energy.

U.S. Pat. No. 4,679,792 to Straza et al, discloses a golf putter head having a striking face insert which comprises a honeycomb cellular structure. The honeycomb cells are filled with a resilient, epoxy material to increase momentum to a golf ball upon impact. An opposite view of this invention.

U.S. Pat. No. 5,083,778 to Douglass discloses an insert of an outer resilient layer of 90 durometers A and an inner resilient layer of 54 durometers Shore D, inset into a club face, as the striking area for the golf ball. Douglass claims a dampened or reduced rebound of the golf ball from the striking face. He utilizes an insert surface of 90 durometers for contact with the ball, achieving reduced rebound but no claim is made to increase work required and/or performed, nor dispersal of energy by the club face. He claims a putter which has decreased surface contact of the golf ball with the striking face of the putter increases control over the golf ball's line of travel, increasing accuracy.

This inventor has proven through analytical analysis, that a full face striking area, using a single layer elastomeric face will absorb and disperse energy, thus, increasing the work required and/or performed. The results of this inventors' findings show that the work required and/or performed for a given distance will be increased. Plotting these results produces force/distance curves that show: The work required and/or performed for this invention far exceeds the work required and/or performed by existing putters. By increasing the work required and/or performed and the work/slope gradient the golfer will have a better instrument to calibrate distances, leading to a more natural stroke of the ball.

FIELD OF INVENTION

This application is in regard to golf clubs, and in particular the golf club putter.

The invention of a putter that will give the golfer a precision instrument with which to improve his game. The desire for better equipment is amply documented by patents researched and disclosed in this application. These patents have concepts directed to creating instruments which state better control, more distance through increased rebound of the ball, or more recently reduced rebound of the ball.

This inventor's concept holds a view that the golfer needs an instrument which increases the work required during the performance of it's given task, putting a golf ball. "Work", as it is used herein is defined by the Laws of Physics, and is a quantitative measurable value (work=force×distance). This instrument also increases the work/slope gradient measured on a force/distance curve. All patents researched have the concept that the putting instrument will reduce the work for the golfer, thereby being in absolute contrast to the concept of this invention.

With the Laws of Physics kept at the forefront, research resulted in a concept that utilizes a resilient material of 55 durometers Shore D for the entire face of the putter, covering a large cavity. The cavity having a shear joint and air/gas egress holes so as to allow the face to absorb and disperse impact loads and increase the work required and/or performed.

DESCRIPTION OF RELATED ART

FIG. 1 of prior an illustrates a golf ball 20 being struck by a putter head 22 with an elastomeric resilient block of material 24 which defines a golf ball striking surface 26. Insert 24 is mounted in and secured to a cavity 28 defined by a metallic body of the putter head.

As illustrated in FIG. 1 deformation occurs rearwardly momentarily into a generally elliptical configuration and then returns to its initial flat shape to impart forward motion to the golf ball. Huggins states "the deformation portion does not deflect the ball laterally as the major part of the deformation is vertical rather than horizontal".

FIG. 2 of prior art is a cross-section view taken along line 2—2 of FIG. 1 and illustrates a golf ball 20 being struck by a putter head 22 with an elastomeric block of material 24 which defines a golf ball striking surface 26. As illustrated in FIG. 2, deformation occurs rearward.

FIG. 3 of prior art illustrates a golf ball 20 being struck by a putter head 28 with a laminated elastomeric insert 30 which defines a golf ball striking surface 32. Insert 30 is mounted in and secured to a cavity 34 defined by a relatively rigid material such as metal, ceramic composite, or graphite composite body 36. As illustrated in FIG. 3, the outer layer 38 bends or yields inwardly without compression to any substantial extent while the inner layer 40 distorts significantly. Douglass contends his invention should experience much less erratic rebounding than that of Huggins FIG. 1.

FIG. 4 of prior art is a cross-sectional view taken along line 4—4 of FIG. 3 and illustrates the laminated insert 30 mounted in a cavity of body 34 and a beveled or dove tailed shaped portion or wall 42.

Both Huggins and Douglass inventions use an elastomeric insert. Though Huggins does not state why he uses resilient blocks of different degree of resiliency other than that it is most effective for a particular user. Douglass however claims a laminated striking face being yieldable to absorb energy when struck by a ball so as to achieve controlled dampening of struck ball.

In both claims results are achieved through distortion of the insert. However Huggins and Douglass retain their inserts totally within a solid cavity. For distortion to occur as they claim material must be displaced. Huggins shows a small unrestrained area in the upper forward and lower forward body cavity opening to obtain his generally elliptical configuration. Douglass claims that a small distortion of outer laminate and a large distortion of the inner laminate will occur, though FIG. 4 shows only a lower forward body cavity opening.

Both make claim that distortion will first occur rearwardly. This inventor disagrees with these findings. For material distortion to occur in a rearward direction the material must be unrestricted and have freedom of displacement in that direction. Early tests prior to Douglass invention showed restrictions such as those claimed, and were marginal at best at controlling damping. Tests were also conducted using putter heads made completely from elastomeric material though some improvements were made to energy absorption, findings were still considered inadequate. Final test results showed a far superior energy absorption where a single layer full face insert, with a purer body contact area solely around the periphery used in combination with a body cavity to allow the face insert freedom of movement and gas/air egress holes to eliminate compressibility effects of the air. The increase in work required by the golfer substantiated analytical analysis and achieved unprecedented success.

FIG. 5 illustrates a work required graph depicting force versus distance. The lower curve 44 is derived based upon a purer having an inelastic striking face at a given weight. The upper curve 46 is derived based upon a purer having an elastic striking face at the same given weight as the lower curve 44.

FIG. 6 illustrates a putter 48 having a shaft 50 with purer head 52 attached to one of the shaft and a gripping portion 54 attached to the shaft's opposite end.

FIG. 7 illustrates a putter head assembly 56 which includes a putter head body 58 of rigid material (preferably made of metal) and a full striking face insert 60.

FIG. 8 is a cross-section along line 8—8 of FIG. 7, which illustrates the putter head assembly 56 striking a ball 20 and the freedom of movement (deflection) which takes place across/with in the full face elastomeric insert 62 and the local deformation occurring at the point of contact 64 when striking a golf ball 20. Also shown is the structural shear joint design 72 of the putter head body 58, and the full face elastomeric insert 62 including the Fusor 305 bond 66. A large cavity 68 is shown and the air/gas egress holes 70 to eliminate compressibility of the air between the full face elastomeric insert 62 and the purer head body 58.

SUMMARY OF THE INVENTION

This invention is the direct result, and summarizes years of research and development into golf club "putter" design. Specifically, the difficulty golfers' experience while attempting to consistently control the distance of a putted golf ball. Factors leading to this difficulty are: golf ball mass, putting surface friction and contour, player skill, and the design of the purer.

Since the inventor controls only the design of the putter he must still consider these factors and develop a product which encompasses the total spectrum.

This inventor in developing his invention first must agree or disagree with previous concepts, that putters will improve accuracy, increase feel, or require the golfer to use a long or short stroke. This inventor believes that accuracy is controlled solely the skill of the golfer, as well the "feel" by ones' individual sense of touch. Feel is immeasurable and therefore is controversial. This inventor also believes that the use of a long stroke or short stroke is also ones' individual preference and cannot be controlled by the putter. Work (work=force×distance) produced is the only quantitative measurable value that can be used. With this in mind this inventor has turned to the Laws of Physics, Engineering and creative design to develop a unique and patentable putter which not only meets the needs of the golfer but also fulfills the rules of the USGA (United States Golf Association) in it's approval authority.

The Physics Laws of Energy, Momentum, Conservation of Momentum, Elastic and Inelastic Collisions, and the Coefficient of Restitution were utilized. Using equations derived from these laws, this inventor developed and determined force required for a given force/distance. Plotting these results produced two work required curves. The first based upon a putter having an inelastic striking face, and second an elastic striking face as shown in FIG. 3. These curves represent ideal conditions and show the maximum theoretical values for a given weight, and were used by the inventor in his determination of distance traveled versus the force required of any putted ball. This inventor using an elastic face and changing the parameters of weight, was able to exceed the conditions shown by these curves, increasing the work required and/or performed.

Since, by the laws of nature the perfect elastic or inelastic material does not exist, inventions which make claims of "Additionally, the elastomer has a resiliency sufficient to cause a golf ball, after penetrating into the elastomeric face to rebound a distance equal to or greater than the distance that a golf ball will rebound when stroked with an equivalent force with a metal face putter.", such as in Tucker claim U.S. Pat. No. 4,422,638 or the claim to damping by Douglass U.S. Pat. No. 5,083,778 which cannot be valid by the virtue that all materials (manmade or natural) are elastic and therefore damping. Therefore putter inventions claiming sole patent rights to damping would appear to be unpatentable. However controlled damping qualities through the use of specified materials should be patentable, since the damping effect of materials can be defined and measured. These damping effects are directly related to the Modulus of Elasticity defined as stated by Hooke's Law developed by Robert Hooke (1676) which defines the elastic properties of a body "for any elastic deformation the stress is proportional to the strain". Therefore Stress/Strain=a constant which is called the Modulus of Elasticity.

It must be noted that the USGA has set minimum values with respect to the modulus of elasticity. The use any materials not falling within their parameters is patentable, but, due to the USGA acting as the sanctioning body for golf, the use of any material falling outside of their parameters would be illegal for use. Therefore, all inventors' must use values above the minimum value of modulus of elasticity for materials as a basis for designing a marketable and proprietary putter. What is not controlled and is patentable is the material selected, quantity used, innovative design and installation features which collectively would develop a novel putter.

BRIEF DESCRIPTIONS OF DRAWINGS

FIG. 1 illustrates previous art indicating laminated insert in club face (Douglass U.S. Pat. No. 5,083,778).

FIG. 2 illustrates a cross-section along line 2—2 of the previous art of FIG. 1.

FIG. 3 illustrates previous art from an insert in club face (Douglass U.S. Pat. No. 5,083,778).

Figure 1:
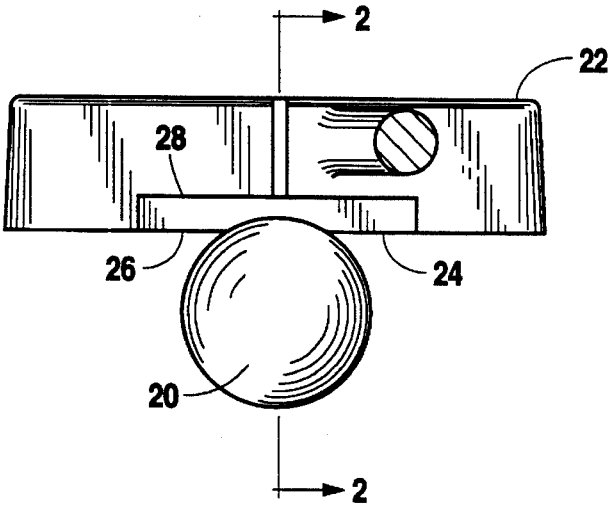
Fig. 1 ( PRIOR ART )
Figure 2:
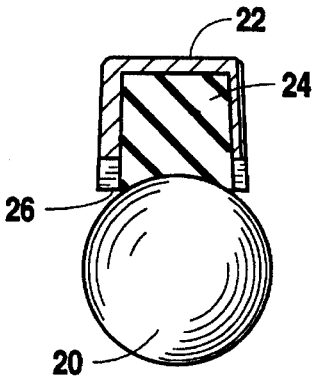
Fig. 2 ( PRIOR ART )
Figure 3:
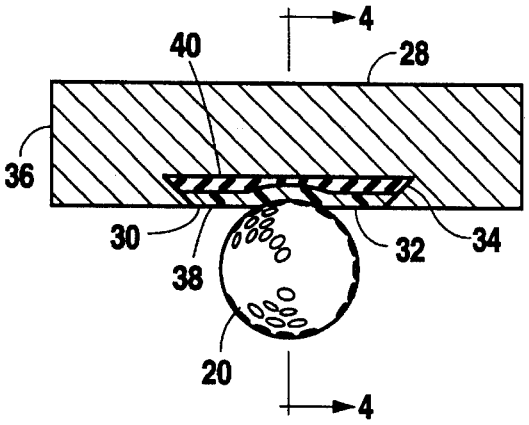
Fig. 3 ( PRIOR ART )
Figure 4:
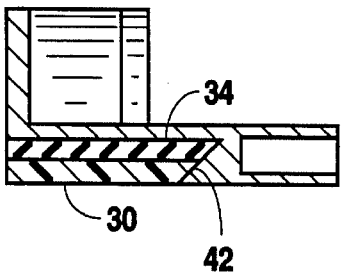
Fig. 4 ( PRIOR ART )
FIG. 4 illustrates a cross section along line 4—4 of the previous art of FIG. 3.
Figure 5:
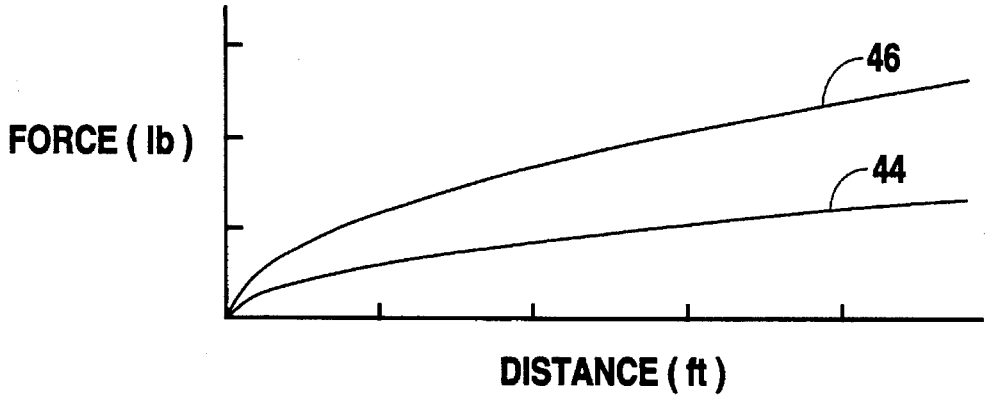
FIG. 5 illustrates plotted curves of (forces vs distance) based upon elastic and inelastic striking face of putter.
Figure 6:
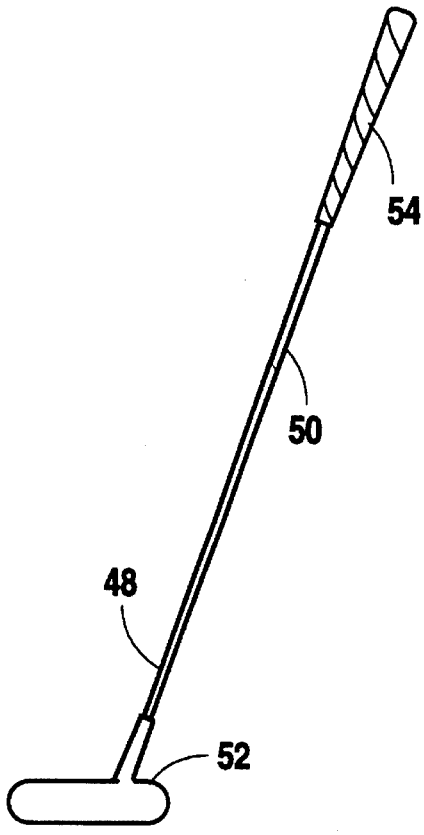
FIG. 6 illustrates complete putter assembly.
Figure 7:
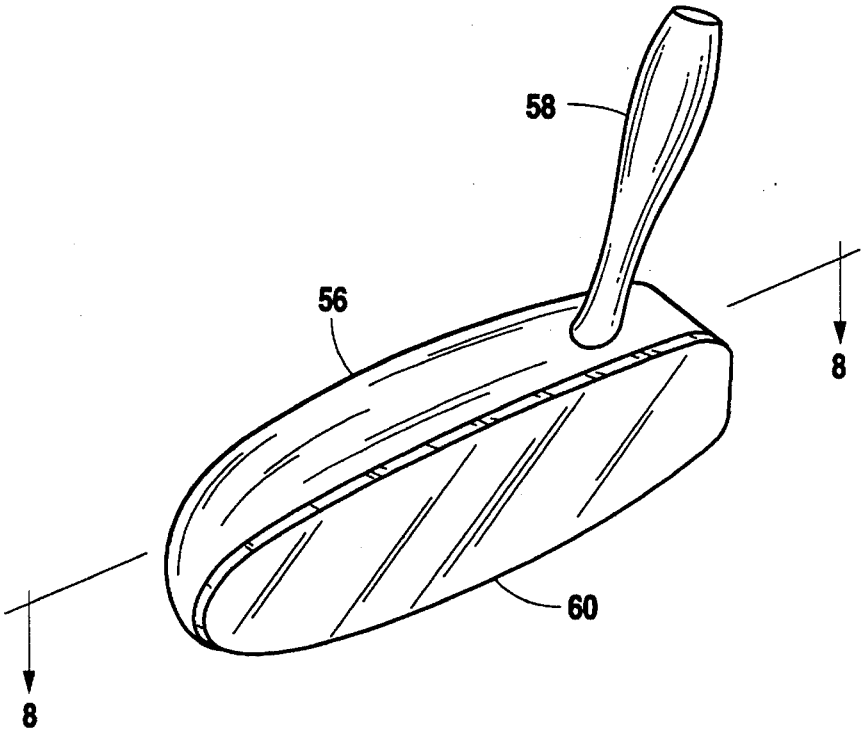
FIG. 7 illustrates full face elastomeric insert in putter head assembly.
Figure 8:
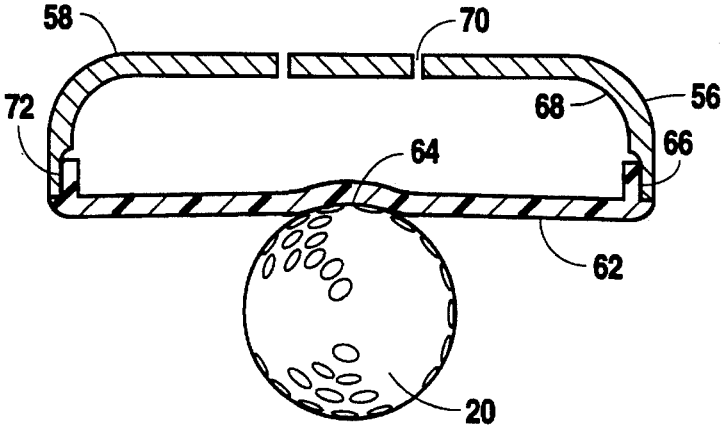

FIG. 8 is a cross section along line 8—8 of FIG. 7, which illustrates the freedom of movement (deflection) which takes place in the elastomeric face insert and the local deformation occurring at the point of contact when striking a golf ball, the structural shear joint of the putter head body assembly and Fusor 305 bond, the large cavity of the putter head body assembly, the air/gas egress holes to eliminate compressibility of the air between the face insert and putter body assembly.

DETAILED DESCRIPTION OF THE INVENTION

A polyether-ester elastomer (ARNITEL® EL 550, a registered trademark of DSM Engineering Plastics) material was selected for manufacturing the face insert as this material has an exceptionally high load-bearing capacity, high flexural-fatigue endurance, high tear strength and abrasion resistance. It stands up well to both high and low temperatures and has good weathering and chemical resistance. It's mechanical properties include a Modulus of Elasticity of 55 durometers Shore D fulfilling the USGA minimum requirement (52 durometers Shore D). This selected material, because of its ability to perform the desired design functions of absorbing energy, while providing a rigid striking surface is considered a major design feature necessary to the performance of the putter. The design and manufacture of the insert requires that injection molding processes be used and consequently a desirable single layer, one piece part is produced. Unlike Douglass who believes erratic rebound of the ball will occur with the use of a single layer face insert, and finds his solution through the use of a multi-layer laminated insert, this inventor finds that the use of a single layer low durometer, energy absorbing face gives the golfer a maximum putting surface with no erratic rebound of the ball while increasing the work required and/or performed.

The putter head body incorporates design features never before utilized in putters and are considered proprietary. The first is the design of the structural shear joint around the periphery of the putter head body as shown in FIG. 8. This feature allows the putter body to be designed with a large cavity as shown in FIG. 8. Consequently an over size putter can be developed which creates the ability for installation of a large full face insert. The size of the insert is directly proportional to energy absorption and therefore the use of a maximized surface area is desirable. Secondly, the design of the shear joint in combination with the cavity allows the face insert freedom of movement. Through this movement impact forces are largely absorbed. Lastly because of the shear joint design, ball impact forces are dispersed though the outer surface walls of the club head. This dispersion of forces maximize work required by the golfer.

Torque of the putter is reduced through this dispersion of forces thus improving the ability of the golfer to control the putter through the putting stroke.

The putter head body also incorporates air/gas egress holes to eliminate compressibility effects of the air between the face insert and the putter body as shown in FIG. 8. This innovative feature used for the first time in this inventors putter allows the unrestricted freedom of movement of the face insert necessary for maximum energy absorption and dispersion of those forces to the periphery of the putter body.

FUSOR® 305 (a registered trademark of Lord Industrial Adhesives) is used for the attachment of the face insert to the putter body. This adhesive was specifically selected due to the ability to provide a structural attachment to shock absorbing devices. The durability of the adhesive also provide energy absorption qualities and is an important feature in the overall design as shown in FIG. 8.

Although the invention is described with respect to a preferred embodiment, modifications thereto will be apparent to those skilled in the art. Therefore, the scope of the invention is to be determined by reference to the claims which follow, and

I claim:

1. A putter comprising:

a shaft having a handle at one end and a putter head assembly at an opposite end;

said putter head assembly including a metal putter body having outer surface walls and a cavity forming an interior of said putter body; said putter body having a forward face portion; said cavity having an open end forming a periphery of said putter body adjacent said outer surface walls at said forward face portion of said putter body;

an adhesive material;

a striking face insert comprising a resilient single layer elastomeric material; said striking face insert being joined to said putter body along said periphery of said putter body with said adhesive material; said face insert and said periphery of said putter body including cooperating structure forming a shear joint connection, whereby the force of an impact between the striking face insert and a golf ball is dispersed through said outer surface walls;

said putter body further including an air egress, whereby air contained within said cavity may escape during compression of said striking face insert during an impact between said insert and a golf ball.

2. The putter of claim 1 wherein said adhesive material is a structural adhesive.

3. The putter of claim 1 wherein said elastomeric material is a polyether-ester material.

4. A putter head comprising:

a putter head assembly including a metal putter head having outer surface walls and a cavity forming an interior of said putter body; said putter body having a forward face portion; said cavity having an open end forming a periphery of said putter body adjacent said outer surface walls at said forward face portion of said putter body;

an adhesive material;

a striking face insert comprising a resilient single layer elastomeric material; said striking face insert being joined to said putter body along said periphery of said putter body with said adhesive material; said face insert and said periphery of said putter body including cooperating structure forming a shear joint connection, whereby the force of an impact between the striking face insert and a golf ball is dispersed through said outer surface walls;

said putter body further including an air egress, whereby air contained within said cavity may escape during compression of said striking face insert during an impact between said insert and a golf ball.

5. The putter head of claim 4 wherein said adhesive material is a structural adhesive.

6. The putter of claim 4 wherein said elastomeric material is a polyether-ester material.

* * * * *